US005982605A

United States Patent [19]

Massey et al.

[11] Patent Number: 5,982,605

[45] Date of Patent: Nov. 9, 1999

[54] SOLENOID DRIVER CIRCUIT FOR USE WITH DIGITAL MAGNETIC LATCHING SOLENOIDS

[75] Inventors: Auldin J. Massey, Ventura; Gregory R. Jokela, Ojai, both of Calif.

[73] Assignee: The United States of America as represented by the Secretary of the Navy, Washington, D.C.

[21] Appl. No.: 09/072,692

[22] Filed: Apr. 28, 1998

Related U.S. Application Data

[63] Continuation-in-part of application No. 09/056,117, Mar. 5, 1998.

[51] Int. Cl.[6] ..... H01H 47/36

[52] U.S. Cl. ..... 361/210; 361/191

[58] Field of Search ..... 361/152, 154, 361/159, 160, 166, 167, 170, 189, 191, 206, 210; 335/230, 256, 234, 266, 253; 251/129.08

[56] References Cited

U.S. PATENT DOCUMENTS

| | | | |
|---|---|---|---|
| 3,683,239 | 8/1972 | Sturman | 361/194 |
| 3,761,730 | 9/1973 | Wright | 307/10.1 |
| 4,630,166 | 12/1986 | D'Onofrio | 361/205 |
| 4,688,138 | 8/1987 | Nagata et al. | 361/154 |
| 5,293,551 | 3/1994 | Perkins et al. | 361/154 |
| 5,644,280 | 7/1997 | Wilson et al. | 335/256 |

*Primary Examiner*—Jeffrey Gaffin
*Assistant Examiner*—Kim Huynh
*Attorney, Agent, or Firm*—David Kalmbaugh

[57] ABSTRACT

A solenoid driver circuit adapted for use with a digital magnetic latching solenoid which has first and second solenoid coils. The solenoid driver circuit includes a bridge circuit which receives a logic signal and first and second pulse signals. The solenoid driver circuit also includes a voltage source which provides a direct current and first and second resistors respectively connected to the first and second solenoid coils. The bridge circuit, responsive to the logic signal and the first pulse signal, provides a first current path from the voltage source through the first solenoid coil and the first resistor to ground and a second current path from the direct current voltage source through the second solenoid coil to ground. The bridge circuit, responsive to the logic signal and the second pulse signal, provides a third current path from the direct current voltage source through the first solenoid coil to ground and a fourth current path from the direct current voltage source through the second solenoid coil and the second resistor to ground. The current flow through the current paths which include a solenoid coil and a resistor is approximately one amp, while the current flow through the currents paths which include only a solenoid coil is approximately twenty six amps. This allows for high speed control of the forces acting on the actuator of the solenoid.

15 Claims, 4 Drawing Sheets

SOLENOID DRIVER CIRCUIT FOR USE WITH DIGITAL MAGNETIC LATCHING SOLENOIDS

This application is a continuation-in-part of U.S. patent application Ser. No. 09/056,117, filed Mar. 5, 1998.

BACKGROUND OF THE INVENTION

1. Field of the Invention

The present invention relates generally to solenoid driver circuits. More specifically, the present invention relates to a solenoid driver circuit which is adapted for use with digital magnetic latching solenoids which operate the valves of a digital seawater pump.

2. Description of the Prior Art

Digital magnetic latching solenoids harness residual magnetism that remains in a magnetic material that has been exposed to a magnetic field using this residual magnetic force to control the solenoid. Magnetic latching solenoids include two opposing coils and an armature. Selectively energizing one coil at a time moves the solenoid armature in a back and forth motion to turn a valve on and off. Each coil of the magnetic latching solenoid also provides the electromagnetic field necessary to establish the residual magnetic force in the armature and solenoid housing. When the armature reaches the end of stroke and the coil turns off residual magnetic force holds the armature against the solenoid housing, locking the solenoid in one position without external power.

Residual magnetism in magnetic latching coils generates high latching forces without the disadvantages associated with permanent magnets, such as susceptibility to demagnetization, cracking, sensitivity to temperature changes and low magnetic efficiency.

Because coils in a magnetic latching solenoid are energized only for an instant, heat dissipation is of no concern. As a result the coils use larger wires with fewer turns than in conventional solenoids and have lower resistance and inductance. This allows the coils to handle high current and generate extremely strong magnetic forces without a requirement to overcome spring force which equates to fast actuation.

Although magnetic latching solenoids do not have to overcome a spring force, the latching force must overcome residual magnetism which holds the solenoid's actuator in the previously latched position. The actuator must also overcome residual magnetism from a distance which is equivalent to the solenoid actuator displacement.

As the solenoid material's magnetic permeability increases the residual magnetism increases toward saturation which makes it harder to de-latch the solenoid using only a latching current pulse. Conventional driver circuits use this latching current pulse to de-latch the solenoid's actuator from its current position.

Further, as displacement of the actuator is increased, the latching force must be decreased to de-latch the solenoid's actuator.

Thus, to design a driver for a magnetic-latching solenoid requires the designer to use sophisticated and expensive EM software and to have a thorough understanding of electromagnetic theory. There is also a need for a driver for a magnetic-latching solenoid which balances latching force requirements and solenoid displacement.

SUMMARY OF THE PRESENT INVENTION

The solenoid driver circuit of the present invention was designed to provide a large actuator displacement and a high attractive force. This, in turn, allows the driver circuit to be adapted for use in activating the magnetic-latching solenoids of the type used in the seawater pump disclosed in U.S. Pat. No. 5,456,581 which issued on Oct. 10, 1995 to James Massey and Gregory R. Jokela, co-inventors of the present invention.

The solenoid driver circuit is adapted for use with a digital magnetic latching solenoid which has a first solenoid coil and a second solenoid coil. The solenoid driver circuit includes a bridge circuit which receives an externally generated logic signal and externally generated first and second pulse signals. The solenoid driver circuit also includes a direct current voltage source which provides a direct current, a first resistor connected to the first solenoid coil and a second resistor connected to the second solenoid coil.

The bridge circuit, responsive to the externally generated logic signal and the first pulse signal, provides a first current path from the direct current voltage source through the first solenoid coil and the first resistor to ground and a second current path from the direct current voltage source through the second solenoid coil to ground allowing direct current to flow through the first current path and the second current path.

The bridge circuit, responsive to the externally generated logic signal and the second pulse signal, provides a third current path from the direct current voltage source through the first solenoid coil to ground and a fourth current path from the direct current voltage source through the second solenoid coil and the second resistor to ground allowing direct current to flow through the third current path and the fourth current path.

The current flow through the current paths which include a solenoid coil and a resistor is minimal, approximately one amp, while the current flow through the currents paths which include only a solenoid coil is approximately twenty six amps. This allows for high speed control of the forces acting on the actuator of the solenoid which latch the solenoid's actuator. In addition, the bridge circuit does not limit the pulse repetition frequency of the solenoids actuator since the bridge circuit is a solid state circuit.

DETAILED DESCRIPTION OF THE PREFERRED EMBODIMENT

Figure 1:
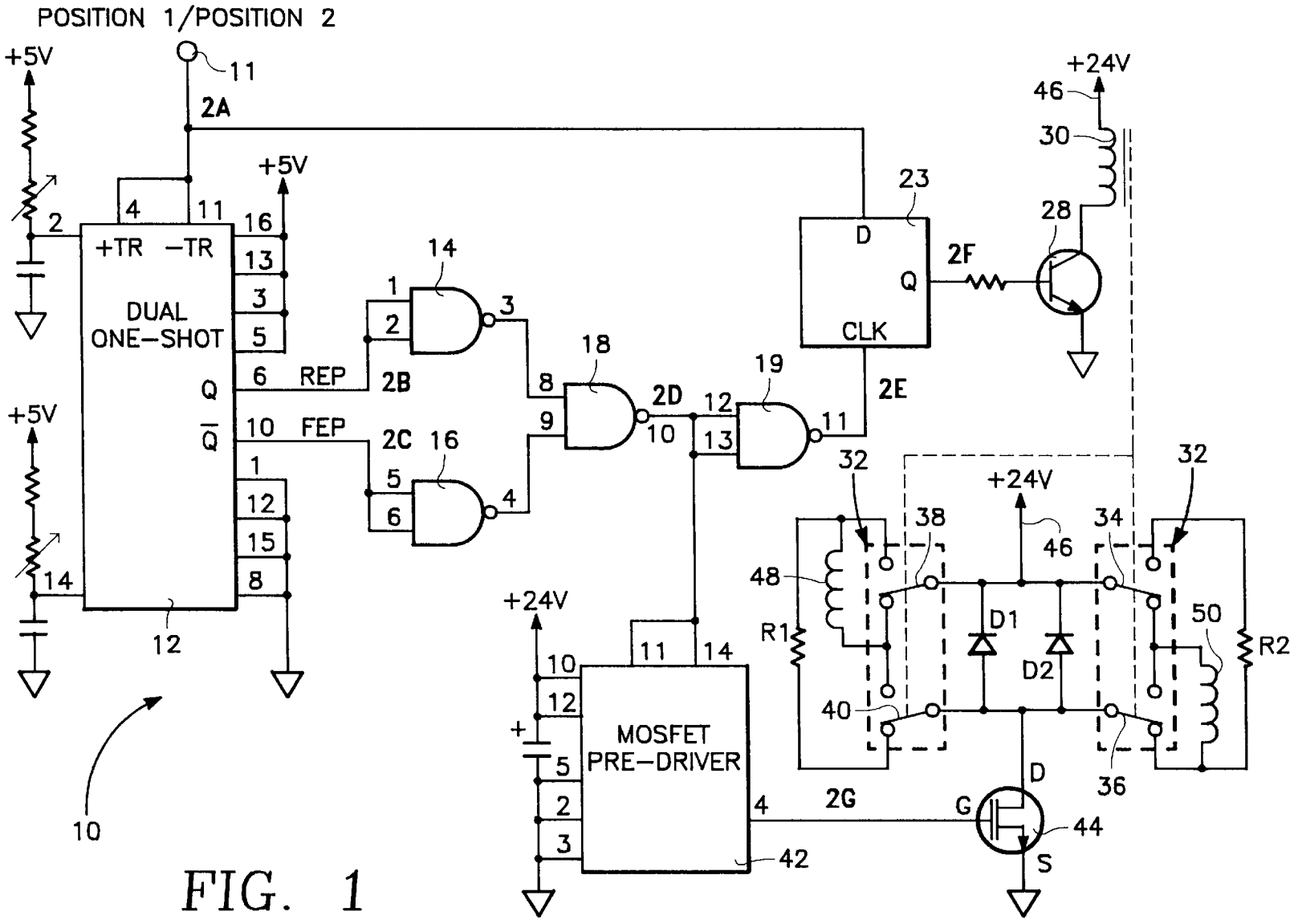
FIG. 1 is a detailed electrical schematic diagram of the solenoid driver circuit for use with digital magnetic latching solenoids which is a preferred embodiment of the present invention.
Figures 2A, 2B, 2C, 2D, 2E, 2F, 2G:
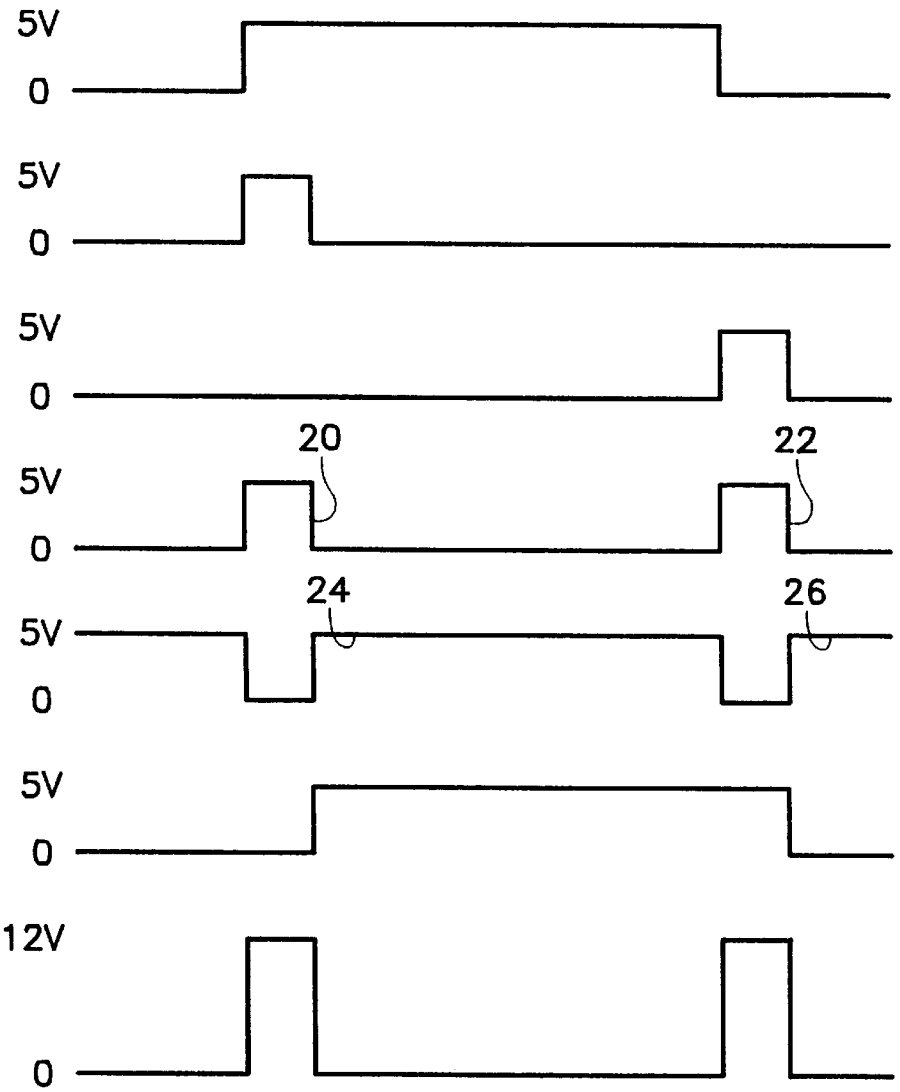
FIGS. 2A–2G is a timing diagram illustrating various waveforms which occur at the inputs and outputs of some of the electrical components of the solenoid driver circuit of FIG. 1.

Referring now to FIGS. 1 and 2, there is shown a solenoid driver circuit 10 for use with digital magnetic latching solenoids. An externally generated position 1/position 2 signal (FIG. 2A) is supplied through an input terminal 11 to the +TR and −TR inputs of a dual monostable multivibrator 12. When the signal of FIG. 2A transitions from the logic zero state to the logic one state, multivibrator 12 generates at its Q output the rising edge pulse of FIG. 2B. In a like manner, when the signal of FIG. 2A transitions from the logic one state to the logic zero state, multivibrator 12 generates at its not Q output the falling edge pulse of FIG. 2C.

The pulse width of the pulses of FIGS. 2B and 2C are adjustable with each pulse having pulse width from about one millisecond to about four milliseconds. The pulse width is a function of the time it takes the actuator/armature of the solenoid to latch. The pulses of FIGS. 2B and 2C are turned off after the actuator/armature has reached its end of travel and sufficient time is provided to set up the required residual magnetism.

The pulse of FIG. 2B is supplied to a NAND gate 14, while the pulse of FIG. 2C is supplied to a NAND gate 16. NAND gates 14 and 16 are configured to function as NOT gates which results in the signals of FIGS. 2B and 2C being respectively inverted by NAND gates 14 and 16. The inverted signals of FIGS. 2B and 2C are next supplied to a NAND gate 18 which provides at its output the pulse signal of FIG. 2D. Pulse 20 of FIG. 2D is generated by NAND gate 18 whenever the rising edge pulse signal of FIG. 2B is at the logic one state, while pulse 22 of FIG. 2D is generated by NAND gate 18 whenever the falling edge pulse signal of FIG. 2C is at the logic one state.

The pulse signal of FIG. 2D is inverted by a NAND gate 19 resulting in the clock signal of FIG. 2E. The clock signal of FIG. 2E is next supplied to the CLK input of a D-Type Flip-Flop 23, while the signal of FIG. 2A is supplied to the D input of D-Type Flip-Flop 23. The rising edge of each clock pulse of the clock signal of FIG. 2E triggers D-Type Flip-Flop 23. The rising edge of pulse 24 triggers D-Type Flip-Flop 23 which results in the logic one at the D input of Flip-flop 23 being transferred to the Q output of D-Type Flip-Flop 23 (FIG. 2F). In a like manner, the rising edge of pulse 26 triggers D-Type Flip-Flop 23 which results in the logic zero at the D input of Flip-flop 23 being transferred to the Q output of D-Type Flip-Flop 23 (FIG. 2F).

The signal of FIG. 2F is supplied to the base of an NPN transistor 28. When the signal of FIG. 2F is at the logic one state, transistor 28 is turned on allowing current to flow through relay coil 30 energizing relay coil 30 of a four pole double throw relay 32. Four pole double throw relay 32 also includes four contacts 34, 36, 38 and 40.

The pulse signal of FIG. 2D is also supplied to a MOSFET Pre-Driver 42 which then generates the 12V gate voltage signal of FIG. 2G. The 12 V gate signal of FIG. 2G is supplied to the gate of a Field Effect Transistor 44 turning on Field Effect Transistor 44 which allows current to flow through Field Effect Transistor 44.

As depicted in FIG. 1, when Field Effect Transistor 44 is turned on, there is a first current path from voltage source 46 through contact 38 of relay 32, solenoid coil 48, a twenty seven ohm resistor R1, contact 40 of relay 42 and Field Effect Transistor 44 to ground. There is also a second current path from voltage source 46 through contact 34 of relay 32, solenoid coil 50, contact 36 of relay 42 and Field Effect Transistor 44 to ground. When the contacts are in the position shown in FIG. 1 approximately 26 amps will flow through solenoid coil 50, while only about one amp will flow through solenoid coil 48 since there is the twenty seven ohm resistor R1 in series with solenoid coil 48.

At this time it should be noted that circuit 10 includes a pair of diodes D1 and D2. The cathodes of diodes D1 and D2 are connected to source 46, while the anodes of diodes D1 and D2 are connected to the drain of Field Effect Transistor 44.

When relay coil 30 of relay 32 is again energized contacts 34, 36, 38 and 40 of relay 32 are toggled. The first current path is now from voltage source 46 through contact 38 of relay 32, solenoid coil 48, contact 40 of relay 42 and Field Effect Transistor 44 to ground. The second current path is now from voltage source 46 through contact 34 of relay 32, a twenty seven ohm resistor R2, solenoid coil 50, contact 36 of relay 42 and Field Effect Transistor 44 to ground. Approximately 26 amps now flows through solenoid coil 48, while only about one amp will flow through solenoid coil 50 since the twenty seven ohm resistor R2 is in series with solenoid coil 50.

It should be noted that the one amp current flow through coil 50 is in the opposite direction of the 26 amps which previously flowed through coil 50. Similarly, the one amp current flow through coil 48 is always in an opposite direction to the 26 amp current flow through coil 48.

The actuator/armature of the magnetic latching solenoid is latched by the solenoid coil of solenoid driver circuit 10 having the 26 amp current flow therethrough. For example, when a latching current of 26 amps flows through solenoid coil 48 the actuator/armature is latched by solenoid coil 48. Simultaneously, current flow through coil 50 is about 1 amp in the opposite direction to the latching current minimizing residual flux in the solenoid's magnet. This minimizes the holding force caused by current flow through coil 50.

The next pulse of the clock signal of FIG. 2E will reverse the current flow through coils 48 and 50 causing coil 50 to latch the actuator/armature of the magnetic latching solenoid. Current flow through coil 48 is now about 1 amp in the opposite direction of the latching current again minimizing residual flux in the solenoid's magnet.

Since the latching solenoid coil 48 or 50 has a 26 amp latching current flowing therethrough, the latching solenoid coil 48 or 50 will generate a large pulling force to move the solenoid's armature without having to overcome a large holding force.

Relay coil 30 and its contacts 34, 36, 38 and 40 are toggled by the clock signal of FIG. 2E after solenoid coils 48 and 50 are energized by the signal of FIG. 2F. Thus, the response time of relay coil 30 does not effect the actuation time of solenoid coils 48 and 50. However, the pulse repetition frequency of solenoid coils 48 and 50 is limited to approximately 100 hertz, since relay coil 30 takes as long as 10 milliseconds to toggle.

Figure 3:
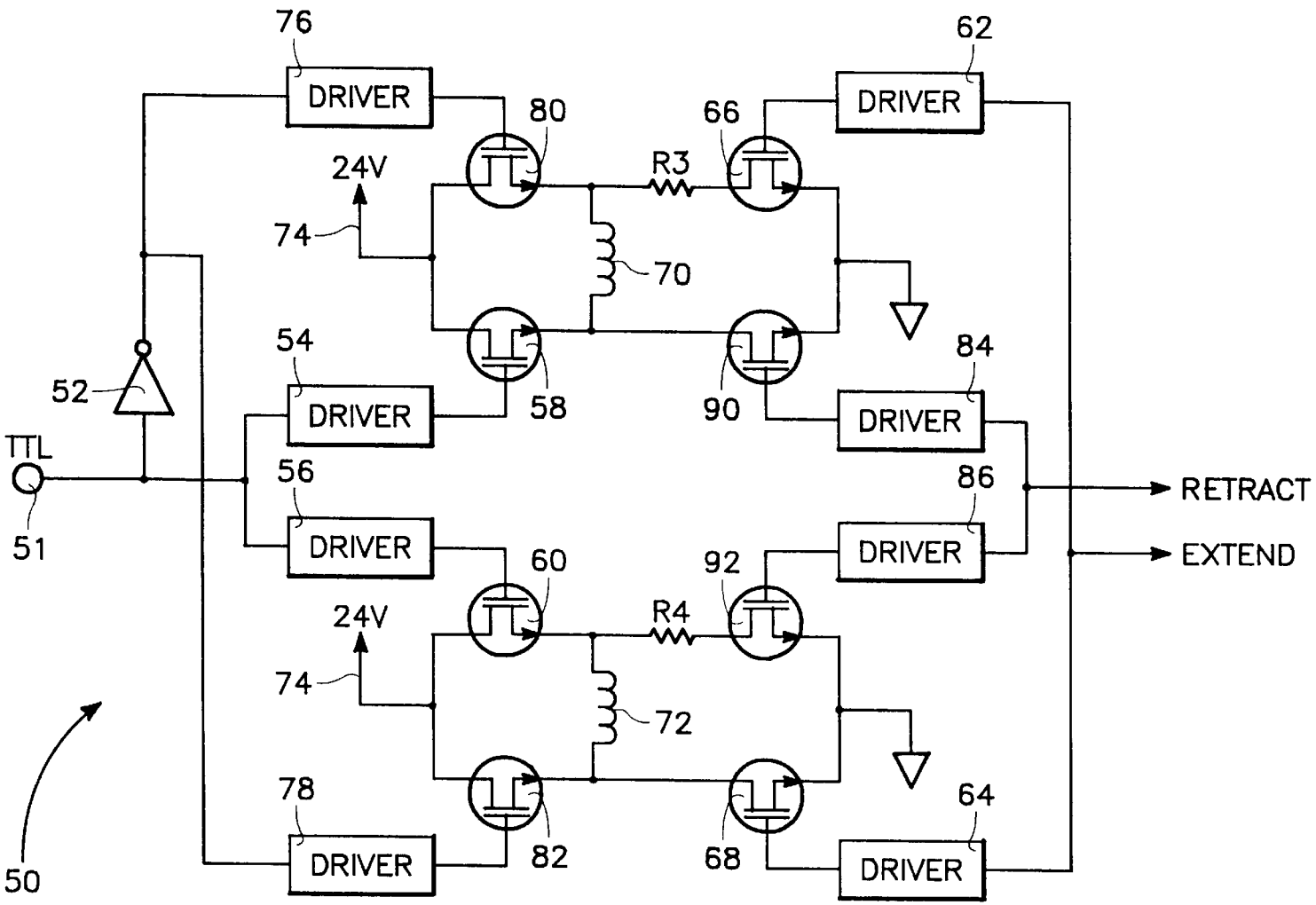
FIG. 3 is an alternate solid state embodiment of a solenoid driver circuit adapted for use with digital magnetic latching solenoids.
Figures 4A, 4B, 4C, 4D:
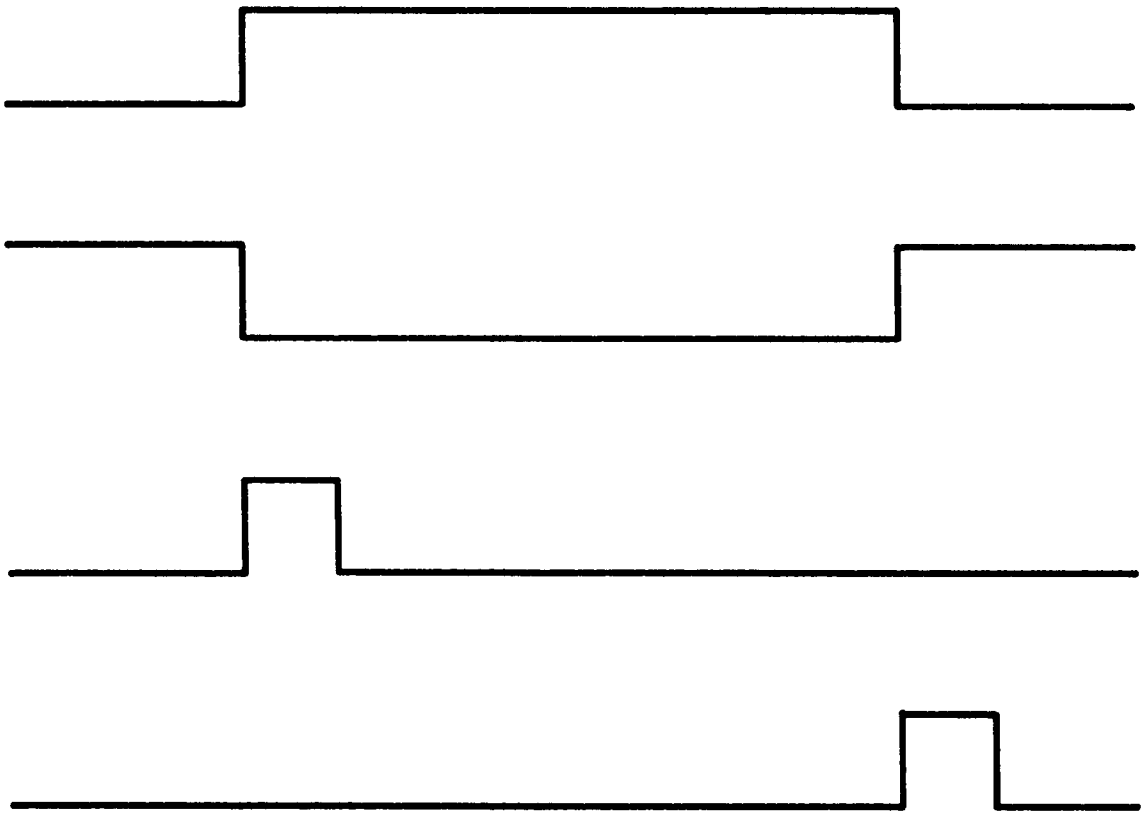
FIGS. 4A–4D is a timing diagram illustrating various waveforms which occur at the inputs and outputs of some of the electrical components of the solenoid driver circuit of FIG. 3.

Referring now to FIGS. 3 and 4, there is shown an alternate embodiment of a solenoid driver circuit 50, which is a solid state driver circuit for use with digital magnetic latching solenoids. A substantially square wave logic signal (FIG. 4A) is supplied through an input terminal 51 to an inverter 52 and drivers 54 and 56. When the signal of FIG. 4A is at the logic one state, drivers 54 and 56 respectively turn on Field Effect Transistors 58 and 60. Simultaneously, an extend pulse signal (FIG. 4C) is provided to drivers 62 and 64. When the signal of FIG. 4C is at the logic one state, drivers 62 and 64 respectively turn on Field Effect Transistors 66 and 68.

There is a first current path from 24 VDC source 74 through Field Effect Transistor 58, solenoid coil 70, resistor R3 and Field Effect Transistor 66 to ground. Simultaneously, there is a second current path from source 74 through Field Effect Transistor 60, solenoid coil 72 and Field Effect Transistor 68 to ground. This results in a large current flow through solenoid coil 72 and a relatively small current flow through solenoid coil 70, which extends the actuator/armature of the magnetic latching solenoid.

The square wave logic signal of FIG. 4A is inverted by inverter 52 resulting in the inverted square wave logic signal of FIG. 4B. When the signal of FIG. 4B is at the logic one state, drivers 76 and 78 respectively turn on Field Effect Transistors 80 and 82. Simultaneously, a retract pulse signal (FIG. 4D) is provided to drivers 62 and 64. When the signal of FIG. 4D is at the logic one state, drivers 84 and 86 respectively turn on Field Effect Transistors 90 and 92.

The first current path is now from source 74 through Field Effect Transistor 80, solenoid coil 70 and Field Effect Transistor 90 to ground. Simultaneously, the second current path is now from source 74 through Field Effect Transistor 82, solenoid coil 72, Resistor R4 and Field Effect Transistor 92 to ground. This results in a large current flow through solenoid coil 70 and a relatively small current flow through solenoid coil 72, which retracts the actuator/armature of the magnetic latching solenoid. Resistors R3 and R4 are approximately 27 ohms. Thus, when field effect transistors 58, 66, 60 and 68 are turned on approximately 26 amps will flow through solenoid coil 72, while only about one amp will flow through solenoid coil 70 since there is the twenty seven ohm resistor R3 in series with solenoid coil 70. Similarly, when field effect transistors 80, 90, 72 and 92 are turned on approximately 26 amps will flow through solenoid coil 70, while only about one amp will flow through solenoid coil 72 since there is the twenty seven ohm resistor R4 in series with solenoid coil 70.

It should be noted that inverter 52, drivers 54, 56, 52, 64, 76, 78, 84 and 86 and field effect transistors 58, 60, 66, 68, 80, 82, 90 and 92 are configured to form an H type bridge circuit. In addition, it should be noted that field effect transistors 58, 60, 66, 68, 80, 82, 90 and 92 function as high speed switching devices.

It should also be noted that circuit 50 does not limit the pulse repetition frequency as does circuit 10 which uses relay coil 30 and its associated contacts 34, 36, 38 and 40 to operate the solenoid coils of the magnetic latching solenoid. This, in turn, allows high speed control of the forces acting on the solenoid actuator of the solenoid and thus allows velocity control of the actuator/armature.

For example, rapid changes in force and direction could be made during actuator movement. Prior to contact actuator movement would slow down and then the latching force would increase after contact. This functions to quiet the solenoid's operation and extends the life of solenoid.

From the foregoing, it may readily be seen that the present invention comprises a new, unique and exceedingly solenoid driver circuit for use with digital magnetic latching solenoids which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A solenoid driver circuit adapted for use with a digital magnetic latching solenoid, said digital magnetic latching solenoid having a first solenoid coil and a second solenoid coil, said solenoid driver circuit comprising:

bridge circuit means for receiving an externally generated logic signal, a first pulse signal and a second pulse signal, said bridge circuit means being connected to said first solenoid coil and said second solenoid coil;

direct current source means for providing a direct current, said direct current source means being connected to said bridge circuit means;

a first resistor having a first terminal connected to said first solenoid coil and a second terminal connected to said bridge circuit means; and a second resistor having a first terminal connected to said second solenoid coil and a second terminal connected to said bridge circuit means;

said bridge circuit means, responsive to said externally generated logic signal and said first pulse signal, simultaneously providing a first current path from said direct current source means through said first solenoid coil and said first resistor to a ground and a second current path from said direct current source means through said second solenoid coil to said ground allowing said direct current to flow through said first current path and said second current path; and said bridge circuit means, responsive to said externally generated logic signal and said second pulse signal, simultaneously providing a third current path from said direct current source means through said first solenoid coil to said ground and a fourth current path from said direct current source means through said second solenoid coil and said second resistor to said ground allowing said direct current to flow through said third current path and said fourth current path.

2. The solenoid driver circuit of claim 1 wherein said bridge circuit means comprises:

an inverter having an input for receiving said externally generated logic signal and an output;

a first driver having an input connected to the output of said inverter and an output;

a second driver having an input for receiving said externally generated logic signal and an output;

a third driver having an input for receiving said externally generated logic signal and an output;

a fourth driver having an input connected to the output of said inverter and an output;

a first switching transistor having an activation input connected to the output of said first driver, a signal input connected to an output of said direct current source means and a signal output connected to a first terminal of said first solenoid coil;

a second switching transistor having an activation input connected to the output of said second driver, a signal input connected to the output of said direct current source means and a signal output connected to a second terminal of said first solenoid coil;

a third switching transistor having an activation input connected to the output of said third driver, a signal input connected to the output of said direct current source means and a signal output connected to a first terminal of said second solenoid coil;

a fourth switching transistor having an activation input connected to the output of said fourth driver, a signal input connected to the output of said direct current source means and a signal output connected to a second terminal of said second solenoid coil;

a fifth driver having an input for receiving said first pulse signal and an output;

a sixth driver having an input for receiving said second retract pulse signal and an output;

a seventh driver having an input for receiving said second pulse signal and an output;

an eighth driver having an input for receiving said first pulse signal and an output;

a fifth switching transistor having an activation input connected to the output of said fifth driver, a signal input connected to the second terminal of said first resistor and a signal output connected to said ground;

a sixth switching transistor having an activation input connected to the output of said sixth driver, a signal input connected to the second terminal of said first solenoid coil and a signal output connected to said ground;

a seventh switching transistor having an activation input connected to the output of said seventh driver, a signal input connected to the second terminal of said second resistor and a signal output connected to said ground; and an eighth switching transistor having an activation input connected to the output of said eighth driver, a signal input connected to the second terminal of said second solenoid coil and a signal output connected to said ground.

3. The solenoid driver circuit of claim 2 wherein each of said first, second, third, fourth, fifth, sixth, seventh and eighth switching transistors comprises a field effect transistor.

4. The solenoid driver circuit of claim 1 wherein said direct current source means comprises a twenty four volt direct current voltage source.

5. The solenoid driver circuit of claim 1 wherein each of said first and second resistors comprises an approximately 27 ohm resistor.

6. The solenoid driver circuit of claim 1 wherein current flow through said first current path and said fourth current path is about one amp.

7. A solenoid driver circuit adapted for use with a digital magnetic latching solenoid, said digital magnetic latching solenoid having a first solenoid coil and a second solenoid coil, said solenoid driver circuit comprising:

driver circuit means for receiving an externally generated logic signal, a first pulse signal and a second pulse signal;

direct current source means for providing a direct current;

a first switching transistor having an activation input connected to said driver circuit means, a signal input connected to an output of said direct current source means and a signal output connected to a first terminal of said first solenoid coil;

a second switching transistor having an activation input connected to said driver circuit means, a signal input connected to the output of said direct current source means and a signal output connected to a second terminal of said first solenoid coil;

a third switching transistor having an activation input connected to said driver circuit means, a signal input connected to the output of said direct current source means and a signal output connected to a first terminal of said second solenoid coil;

a fourth switching transistor having an activation input connected to driver circuit means, a signal input connected to the output of said direct current source means and a signal output connected to a second terminal of said second solenoid coil;

a first resistor having a first terminal connected to the first terminal of said first solenoid coil and a second terminal connected to said driver circuit means;

a second resistor having a first terminal connected to the first terminal of said second solenoid coil and a second terminal connected to said driver circuit means;

a fifth switching transistor having an activation input connected to said driver circuit means, a signal input connected to the second terminal of said first resistor and a signal output connected to a ground;

a sixth switching transistor having an activation input connected to said driver circuit means, a signal input connected to the second terminal of said first solenoid coil and a signal output connected to said ground;

a seventh switching transistor having an activation input connected to said driver circuit means, a signal input connected to the second terminal of said second resistor and a signal output connected to said ground; and an eighth switching transistor having an activation input connected to said driver circuit means, a signal input connected to the second terminal of said second solenoid coil and a signal output connected to said ground;

said driver circuit means, responsive to said externally generated logic signal and said first pulse signal, turning on said second switching transistor, said third switching transistor, said fifth switching transistor and said eighth switching transistor to provide a first current path from said direct current source means through said first solenoid coil and said first resistor to a ground and a second current path from said direct current source means through said second solenoid coil to said ground allowing said direct current to flow through said first current path and said second current path; and said driver circuit means, responsive to said externally generated logic signal and said second pulse signal, turning on said first switching transistor, said fourth switching transistor, said sixth switching transistor and said seventh switching transistor to provide a third current path from said direct current source means through said first solenoid coil to said ground and a fourth current path from said direct current source means through said second solenoid coil and said second resistor to said ground allowing said direct current to flow through said third current path and said fourth current path.

8. The solenoid driver circuit of claim 7 wherein each of said first, second, third, fourth, fifth, sixth, seventh and eighth switching transistors comprises a field effect transistor.

9. The solenoid driver circuit of claim 7 wherein said direct current source means comprises a twenty four volt direct current voltage source.

10. The solenoid driver circuit of claim 7 wherein each of said first and second resistors comprises an approximately 27 ohm resistor.

11. The solenoid driver circuit of claim 7 wherein said driver circuit means comprises:

an inverter having an input for receiving said externally generated logic signal and an output;

a first driver having an input connected to the output of said inverter and an output connected to the activation input of said first switching transistor;

a second driver having an input for receiving said externally generated logic signal and an output connected to the activation input of said second switching transistor;

a third driver having an input for receiving said externally generated logic signal and an output connected to the activation input of said third switching transistor;

a fourth driver having an input connected to the output of said inverter and an output connected to the activation input of said fourth switching transistor;

a fifth driver having an input for receiving said first pulse signal and an output connected to the activation input of said fifth switching transistor;

a sixth driver having an input for receiving said second pulse signal and an output connected to the activation input of said sixth switching transistor;

a seventh driver having an input for receiving said second pulse signal and an output connected to the activation input of said seventh switching transistor; and an eighth driver having an input for receiving said first pulse signal and an output connected to the activation input of said eighth switching transistor.

12. The solenoid driver circuit of claim 7 wherein current flow through said first current path and said fourth current path is about one amp.

13. A solenoid driver circuit adapted for use with a digital magnetic latching solenoid, said digital magnetic latching solenoid having a first solenoid coil and a second solenoid coil, said digital magnetic latching solenoid comprising:

an inverter having an input for receiving an externally generated square wave logic signal and an output;

a first driver having an input connected to the output of said inverter and an output;

a second driver having an input for receiving said externally generated square wave logic signal and an output;

a third driver having an input for receiving said externally generated square wave logic signal and an output;

a fourth driver having an input connected to the output of said inverter and an output;

a direct current voltage source having an output;

a first field effect transistor having a gate connected to the output of said first driver, a drain connected to the output of said direct current voltage source and a source connected to a first terminal of said first solenoid coil;

a second field effect transistor having a gate connected to the output of said second driver, a drain connected to the output of said direct current voltage source and a source connected to a second terminal of said first solenoid coil;

a third field effect transistor having a gate connected to the output of said third driver, a drain connected to the output of said direct current voltage source and a source connected to a first terminal of said second solenoid coil;

a fourth field effect transistor having a gate connected to the output of said fourth driver, a drain connected to the output of said direct current voltage source and a source connected to a second terminal of said second solenoid coil;

a first resistor having a first terminal connected to the first terminal of said first solenoid coil and a second terminal;

a second resistor having a first terminal connected to the first terminal of said second solenoid coil and a second terminal;

a fifth driver having an input for receiving an externally generated extend pulse signal and an output;

a sixth driver having an input for receiving an externally generated retract pulse signal and an output;

a seventh driver having an input for receiving said externally generated retract pulse signal and an output;

an eighth driver having an input for receiving said externally generated extend pulse signal and an output;

a fifth field effect transistor having a gate connected to the output of said fifth driver, a drain connected to the second terminal of said first resistor and a source connected to a ground;

a sixth field effect transistor having a gate connected to the output of said sixth driver, a drain connected to the second terminal of said first solenoid coil and a source connected to said ground;

a seventh field effect transistor having a gate connected to the output of said seventh driver, a drain connected to the second terminal of said second resistor and a source connected to said ground; and an eighth field effect transistor having a gate connected to the output of said eighth driver, a drain connected to the second terminal of said second solenoid coil and a source connected to said ground.

14. The solenoid driver circuit of claim 13 wherein said direct current voltage comprises a twenty four volt direct current voltage source.

15. The solenoid driver circuit of claim 13 wherein each of said first and second resistor comprises an approximately 27 ohm resistor.

* * * * *